US005800095A

United States Patent [19]

Egan

[11] Patent Number: 5,800,095

[45] Date of Patent: Sep. 1, 1998

[54] COMPOSITE RETAINING WALL

[75] Inventor: Philip D. Egan, Atlanta, Ga.

[73] Assignee: The Tensar Corporation, Atlanta, Ga.

[21] Appl. No.: 784,104

[22] Filed: Jan. 15, 1997

[51] Int. Cl.[6] ..... E02D 29/02

[52] U.S. Cl. ..... 405/262; 405/284; 405/286

[58] Field of Search ..... 405/262, 284, 405/285, 286, 258, 272, 273

[56] References Cited

U.S. PATENT DOCUMENTS

| | | | |
|---|---|---|---|
| 3,686,873 | 8/1972 | Vidal . | |
| 4,117,686 | 10/1978 | Hilfiker . | |
| 4,324,508 | 4/1982 | Hilfiker et al. . | |
| 4,329,089 | 5/1982 | Hilfiker et al. . | |
| 4,343,572 | 8/1982 | Hilfiker . | |
| 4,374,798 | 2/1983 | Mercer . | |
| 4,391,557 | 7/1983 | Hilfiker et al. . | |
| 4,514,113 | 4/1985 | Neumann | 405/262 X |
| 4,616,959 | 10/1986 | Hilfiker . | |
| 4,618,283 | 10/1986 | Hilfiker . | |
| 4,643,618 | 2/1987 | Hilfiker et al. . | |
| 4,834,584 | 5/1989 | Hilfiker . | |
| 4,856,939 | 8/1989 | Hilfiker . | |
| 4,904,124 | 2/1990 | Egan . | |
| 4,929,125 | 5/1990 | Hilfiker . | |
| 4,961,673 | 10/1990 | Pagano et al. . | |
| 5,064,313 | 11/1991 | Risi et al. . | |
| 5,076,735 | 12/1991 | Hilfiker . | |
| 5,156,495 | 10/1992 | Mercer . | |
| 5,451,120 | 9/1995 | Martinez-Gonzalez | 405/262 |
| 5,540,525 | 7/1996 | Miller et al. . | |
| 5,568,998 | 10/1996 | Egan et al. . | |

FOREIGN PATENT DOCUMENTS

| | | | |
|---|---|---|---|
| 1112729 | 11/1955 | France | 405/262 |
| 0284321 | 11/1988 | Japan | 405/262 |

OTHER PUBLICATIONS

"Construction Methods, Economics and Specifications" P.M. Jarrett and McGown(Eds.) The Application of Polymeric Reinforcement in Soil Retaining Structures, 573–611 (1988) by Kluwer Academic Publishers.

Aashto Standard Specifications For Highway Bridges, 1997 Interims.

*Primary Examiner*—Dennis L. Taylor

*Attorney, Agent, or Firm*—Jacobson, Price, Holman & Stern, PLLC

[57] ABSTRACT

A retaining wall having a height of greater than ten feet which includes a lower section of inextensible reinforcements and an upper section of extensible reinforcements. By the use of inextensible reinforcements in place of extensible reinforcements in a lower portion of a wall having a height greater than ten feet, the lower portion of the wall will tend to distribute the stresses of soil compaction and require less quality control/assurance during construction. Further, by the use of extensible reinforcements in the upper section of a retaining having a height greater than ten feet, the extensible reinforcements will maintain the retaining wall in place and have significantly improved corrosion resistance over inextensible metal reinforcements.

29 Claims, 1 Drawing Sheet

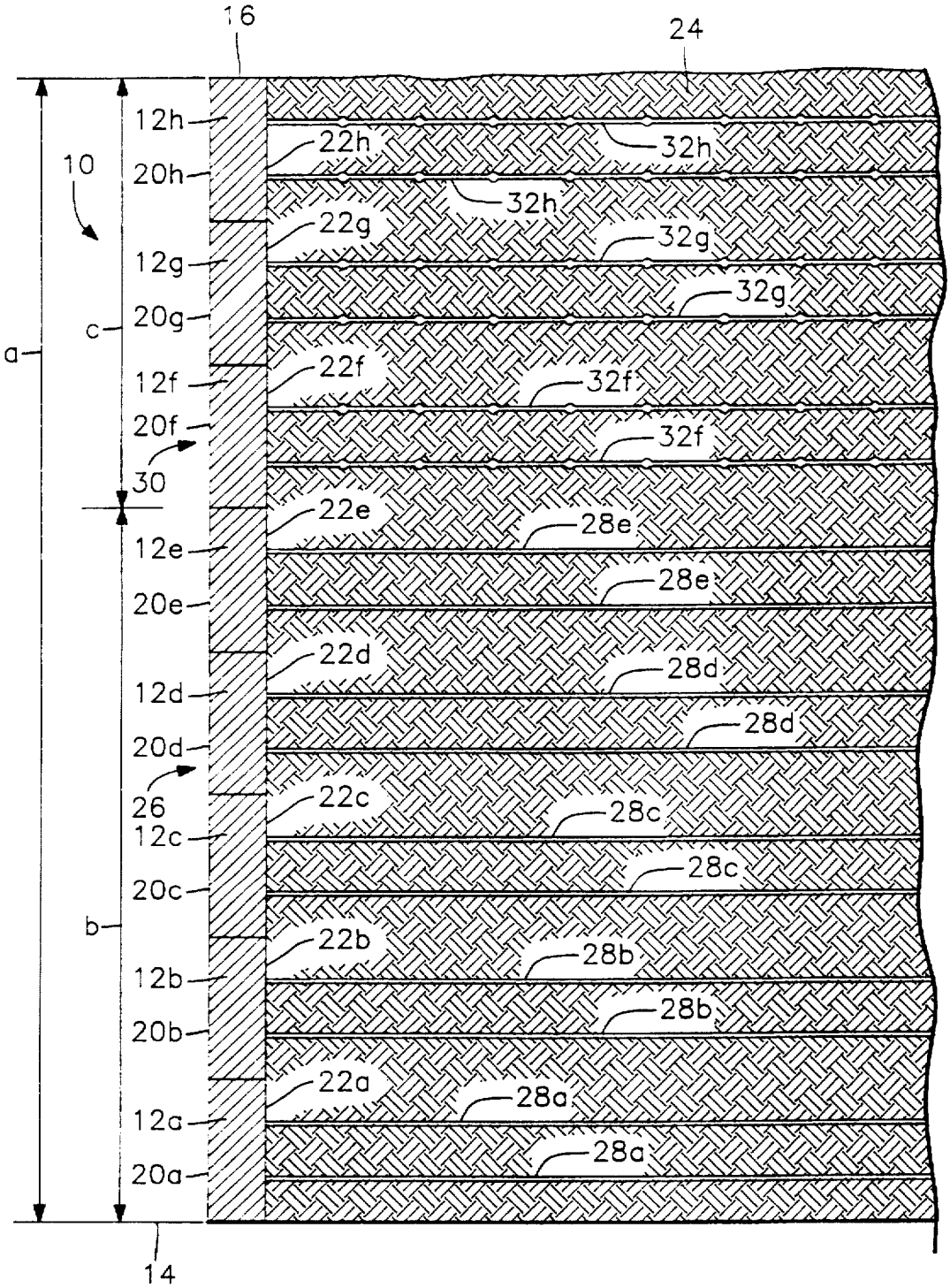
16
24
10
12h
20h
22h
32h
32h
22g
32g
12g
32g
20g
c
a
22f
32f
12f
20f
32f
30
22e
28e
12e
28e
20e
22d
28d
12d
28d
20d
26
22c
28c
12c
28c
20c
b
22b
28b
12b
28b
20b
22a
28a
12a
28a
20a
14

COMPOSITE RETAINING WALL

FIELD OF THE INVENTION

The present invention relates to the field of reinforced retaining walls including a concrete or plastic facing system having separate and distinct reinforcing materials zones made up of extensible and inextensible reinforcing materials extending rearwardly from the facing system into fill material. The inextensible reinforcements are located in a lowermost zone of the wall and the extensible reinforcements are located in an uppermost zone of the wall.

BACKGROUND OF THE INVENTION

Reinforced soil structures must be of a practical form which is developed based upon idealization and analysis of a job site. The theoretical form of a structure may be different from the economical prototype. Accordingly, attention is paid to different construction methods throughout the design process. Speed as well as economy of construction are always considered, resulting in a preferred construction technique which tends to be as simple as possible.

Modern forms of reinforced soil located behind a retaining wall facing system have evolved over time based upon an understanding of effective construction techniques. Early structures reinforced the soil or fill behind a retaining wall facing system with steel strips. The use of polymeric reinforcements was developed in the early 1970's when high density polyethylene grids were employed to reinforce railway embankments in Japan.

Commonly, in constructing a retaining wall, layers of soil or other aggregate materials are deposited about elongated reinforcements which extend generally parallel to the failure plane of the fill from the rear of the facing. Deformations occurring in the soil mass are caused by both gravitational and compaction forces. These deformations cause the reinforcing elements, which are positioned on discrete planes in the soil, to move together and become tensioned as the layers of soil separating the planes of reinforcement are both compressed vertically and expanded laterally. Accordingly, a construction technique which is capable of accommodating internal soil consolidation and strain of the soil is required.

The failure to accommodate the compression of the soil may result in the deformation of the face of a retaining wall, or even collapse of the wall. However, restriction on the lateral expansion of the fill may prevent the required tension in the reinforcement system from developing fully.

One method of construction of a retaining wall makes use of full height concrete panels as a facing. In some instances, such full height panels are constructed using rigid steel strip or wire mesh reinforcements of the fill. However, with the use of such inextensible reinforcement, severe and unacceptable distortion of the facings may occur particularly when there is no provision for relative movement between the reinforcement and the wall panels as the fill settles and deforms laterally. Thus, in using steel reinforcements accommodation must be made for movement of the reinforcing anchors relative to the facing.

Another problem associated with conventional inextensible reinforcing materials such as steel strips or wire mesh is the relatively short life span of such materials particularly in the highly corrosive environment commonly existing in a soil fill setting. Although retaining walls are desirably constructed for long term use, especially higher walls found in more critical civil engineering applications, the disintegration of steel reinforcing material becomes a limiting factor in such situations.

Glass reinforced plastic strips or tapes have longer life span, but the development of polymeric grids having molecularly oriented strands and less oriented junctions, known in the industry Gas integral "geogrids", provides reinforcing materials of limited extensibility which retain their coherence for up to 120 years, even in highly corrosive environments. Due to the low bending stiffness of geogrids, such materials offer greater flexibility to accommodate settlement than inextensible reinforcements such as steel strips or wire mesh. However, the use of geogrids usually requires a good quality fill which can be well compacted to reduce settlement and ensure good service performance.

While cast concrete panel facing systems are particularly adapted for the construction of retaining walls, smaller size modular wall blocks are especially useful in building walls of a relatively low height since they are easier to handle and require little or no heavy equipment. Even with retaining walls made of modular wall blocks, horizontal layers of reinforcement such as sheets of geogrid material are commonly secured between selected rows of the blocks to improve the stability of the fill.

Extensible reinforcements generally include geotextiles or geogrids. They reach their peak strength at strains equal to or greater than the strain required for soil to reach its peak strain and have a modulus of elasticity, $E_E$, between about $10\times10^3$ and about $10\times10^5$ PSI.

Inextensible reinforcements generally include metal strips, metal bars, or welded metal wire mats or mesh materials. Inextensible reinforcements reach their peak strength at strains lower than the strain required for the soil to reach its peak strain and have a modulus, $E_I$, between about $10\times10^6$ and about $30\times10^6$ PSI.

Depending upon the particular application, preferred materials for the extensible reinforcements of the instant invention, may be uniaxially or biaxially oriented integral structural geogrids or bonded composite woven or knitted structural textiles. The description of preferred forms of these materials are found in co-pending, commonly assigned U.S. patent application Ser. No. 08/643,182 filed May 9, 1996, and U.S. patent application Ser. No. 08/696,604, filed Aug. 14, 1996, the subject matter of which are incorporated herein in their entirety, by reference.

The preferred form of uniaxially or biaxially oriented integral structural geogrids are commercially available from The Tensar Corporation of Atlanta, Ga. ("Tensar") and are made by the process disclosed in U.S. Pat. No. 4,374,798, the subject matter of which is also incorporated herein in its entirety by reference. The '798 patent discloses the use of integral geogrids for preventing retaining walls from being forced out of position by the pressure of particulate material behind them.

According to the '798 patent, a high strength integral geogrid may be formed by stretching an apertured plastic sheet material. Utilizing the uniaxial techniques, a multiplicity of molecularly-oriented elongated strands and transversely extending bars which are substantially unoriented or less-oriented than the strands are formed in a sheet of high density polyethylene, although other polymer materials may be used in lieu thereof. The strands and bars together define a multiplicity of grid openings. With biaxial stretching, the bars are also formed into oriented strands.

Where high strength is required, the preferred grid-like sheet material is a uniaxially-oriented geogrid material. However, biaxial geogrids or grid materials that have been made by different techniques such as woven, knitted or netted grid materials formed of various polymers including the polyolefins, polyamides, polyesters and the like or fiberglass, may be used. The grid-like sheet material must be capable of being secured to concrete or plastic blocks or panels.

The mesh structure is normally placed parallel to the surface of the particulate material. The oriented strands will extend parallel to the line of expected tension on the mesh structure. This enables the tensile strength of the mesh structure to be fully exploited. A number of parallel layers of the mesh structure are generally spaced, one above the other, buried in the earth. An end of each layer is incorporated in or secured to the retaining wall. The mesh structure provides good slip resistance properties with respect to the earth so that the mesh structures act as a tie to prevent the retaining wall from being forced out of its vertical position.

In construction, soil is placed on a generally horizontal first layer of the mesh structure to embed the first layer in the soil and to apply a continuous load in the direction of the oriented strands to increase the strength of the soil around the first layer of mesh structure. A generally horizontal second layer of mesh structure is then applied and the process repeated until reaching the height of the wall.

Various techniques and constructions are known for using either extensible reinforcements or inextensible reinforcements to stabilize a retaining wall, whether the facing system is in the nature of preformed concrete panels or modular wall blocks. For example, the use of an extensible reinforcement to reinforce a modular wall block retaining wall is found in U.S. Pat. No. 5,540,525 and the use of such a reinforcement with a retaining wall formed of concrete panels is found in U.S. Pat. No. 5,568,998, both of these patents being assigned to The Tensar Corporation of Morrow, Ga., and incorporated in their entirety herein, by reference.

In the '525 patent, a modular wall block is formed with a trough in a portion of a recessed area in its upper surface. A rigid comb-like connection device is provided which includes a multiplicity of finger elements adapted to extend through openings in the end portion of a grid-like sheet of material into frictional engagement with the side walls of the portions of the block forming the trough. The frictional component of the finger elements against the concrete trough side walls may be enhanced by serrations along the edges of the finger elements to thereby securely lock the grid-like sheet of material in place.

At a construction site, a plurality of modular wall blocks are stacked in staggered, vertically superimposed, courses. Grid connection devices are secured within the troughs of wall blocks of selected blocks to capture the end portions of elongated lengths of grid-like sheet of material, the remainder of which is stretched out and interlocked with the fill soil or aggregate. The sheets of grid-like sheet of material reinforce the fill so as to create a stable mass behind the retaining wall.

In the '998 patent, precast concrete wall panels are provided which may measure, for example, approximately 5 feet in height by 9 feet wide. Extended lengths of grid-like reinforcing sheet material are attached to the precast panels by a connector comb similar to that used in the '525 patent. With the full size panels, short strips of geogrid material are embedded during the casting to extend from the rear of the panel. End portions of the reinforcing grid sheet are positioned between the strips of geogrid and the fingers of the comb-like connector are passed through aligned openings of the various geogrid elements and captured by a locking clip.

Many other techniques may be used to attach different types of extensible reinforcing sheets to a retaining wall facing element and the foregoing references are described merely as illustrative.

Likewise, inextensible reinforcing materials have been incorporated into retaining wall systems by a variety of means. Some examples of strip-like metal reinforcements will be found in U.S. Pat. Nos. 3,686,873; 4,834,584; and 4,961,673, each of which is incorporated herein in its entirety, by reference.

In the '873 patent, a plurality of elongated metal reinforcing elements in the shape of rectangular strips, are secured by a nut and bolt assembly to the rear face of a retaining wall. A projection emanating from the rear face of each section of the wall provides an attachment point for securing the strips thereto.

In the '584 patent, a reinforcement system is disclosed by which a plurality of undulating metal rods are secured to a rear face of the panels of a retaining wall. The rods may also be straight and include perpendicular extending arms. The rods frictionally reinforce the retaining wall formation and produce a stable, cohesive reinforced soil embankment wall.

In the '673 patent, a retaining wall includes a plurality of metal tensile members dispersed within the fill material behind the wall to enhance the coherency of the mass. The tensile members, at least in part, frictionally engage the granular soil or fill material. These strips are shown as elongated, rectangular-shaped tensile member strips or strips attached to metal grid. The compacted fill soil is described as co-acting with the tensile members to distribute stresses throughout the fill material and thus enhance the coherency of the fill material as contrasted with fill material not having any such tensile members.

The use of inextensible reinforcements in the form of welded wire mesh are found in U.S. Pat. Nos. 4,324,508; 4,343,572; and 4,643,618, herein incorporated in their entirety by reference.

In the '508 patent, welded wire mesh mats are secured to precast elongated panels disposed at the face of a retaining wall. A plurality of pin members project above the upper surface of each panel. The wire mesh is engaged with the pins and secured in place by the cooperation of the pins with a superimposed panel.

Alternatively, sections of wire mesh are secured to a rear face of the panels. Anchor numbers are cast in the panels with loop portions projecting from the rear face of each panel. Extended wires from the wire mats engage and are secured to the loop portions.

In the '572 patent, a rigid face member of a retaining wall is held in place at the face of an earthen formation by anchor elements embedded within the formation. The anchor elements comprise welded wire grids. One end of the mats include rods which are cast in place within the concrete face member. The mats reinforce the back-filled retaining wall and secure the face member against displacement.

In the '618 patent, a retaining wall for an earthen formation is anchored by a plurality of mats embedded in the wall at vertically spaced levels. The mats are sections of welded wire having angled portions cast in place within the face of the sections of the retaining wall to both reinforce the wall and secure the wall against displacement relative to the reinforcing members.

Accordingly, retaining walls incorporating facing materials, whether full height or pre-cast panels or modular wall blocks formed of concrete or plastic generally include reinforcing materials extending in layers parallel to the failure plane of the fill material located behind the wall. The reinforcement system is effected based on frictional engagement and/or strike through of the fill with the reinforcing material. Heretofore, such reinforcement systems have been formed entirely of either an extensible reinforcement material or an inextensible reinforcement material resulting in a compromising of the properties of the reinforced retaining wall because of the limitations inherent in each system.

In a traditional soil reinforced wall using entirely extensible reinforcements, wall deformation of tall walls having a height of greater than twenty feet exceeds the deformation normally associated with inextensible reinforcements. The extensible reinforcements, at the lower portion of the wall, yield a relatively large amount.

Alternatively, in a traditional soil reinforced wall using entirely inextensible reinforcements, only slight wall deformation of walls having a height greater than twenty feet is produced in the wall. However, in low walls using inextensible reinforcements, the walls tend to produce a curvature distortion along its vertical height.

The traditional inextensible reinforced wall using steel reinforcements yielding only a small amount within the upper part of a tall wall constrains the soil in a high state of stress. The high state of stress is a well-known consequence of using steel or inextensible reinforcements which results in a wall which could excessively deform and catastrophally fail if the locked-in high state of horizontal stresses ($K_o$) become unconstrained due to the loss of strength from steel inextensible reinforcements as a result of rust and corrosion of these inextensible reinforcements.

In addition, a drawback of the total use of inextensible reinforcements is produced by the use of de-icing salts and other corrosive run-off. The percolate of these caustic substances passes into the upper sections of a wall causing deterioration of the strength of the metal-based inextensible reinforcements. Yet, research has indicated that the percolation of such caustic substances are limited in depth. That is, the percolate resides only within the upper portion of a wall and the caustic substances do not generally reach a depth greater than about five feet.

SUMMARY OF THE INVENTION

Accordingly, it is an object of the present invention to provide a retaining wall having a height of greater than or equal to about ten feet which uses a lower section of inextensible reinforcements and an upper section of extensible reinforcements. The retention of the facing materials is maintained while producing advantageous benefits distinguishing over prior walls made up entirely of inextensible reinforcements or entirely of extensible reinforcements.

By the use of inextensible reinforcements in place of extensible reinforcements in a lower portion of a wall having a height equal to or greater than about ten feet, the lower portion of the wall will tend to resist the large horizontal forces of soil compaction without the lateral deflections associated with extensible reinforcements. Further, by the use of extensible reinforcements in the upper section of a retaining having a height greater than about ten feet, the extensible reinforcements will maintain the retaining wall in place without locked-in high state of stresses ($K_o$) associated with inextensible reinforcements. Also, extensible reinforcements have significantly improved corrosion resistance over inextensible metal reinforcements, particularly in the critical upper portion of a wall subject to percolation.

For all intents and purposes, the depth to which water run-off and corrosive salts will percolate in a composite reinforced retaining wall according to this invention is designed to be above the level at which the metal inextensible reinforcements are incorporated. Effectively, a cushion of soil is provided to protect the metal reinforcements which are located deep within the fill material.

The ratio of the modulus of elasticity for the inextensible reinforcement used in the composite reinforced retaining walls of this invention to the modulus of elasticity for the extensible reinforcements, ($E_I/E_E$), is preferably greater than ten and less than about 3000. Above a value of about 3000, no additional advantage is obtained.

The present invention is equally applicable to retaining walls regardless of the facing system utilized, i.e. whether the wall is formed of modular wall blocks, precast panels, or other such materials. Further, the manner in which the extensible and inextensible reinforcements are attached to the facing materials is not a part of this invention, any conventional system such as those illustrated in the above-identified exemplary patents, or other comparable techniques, being acceptable. Finally, the specific nature of the extensible and inextensible reinforcing materials is not the key to the instant inventive concepts, the extensible reinforcements including, inter alia, integral uniaxial or biaxial geogrids, woven or knitted bonded composite open mesh structural textiles, woven or knitted geotextiles, and the inextensible reinforcements including, inter alia, elongated metal strips or rods and welded wire mesh materials.

Thus, the primary object of this invention is the provision of a composite reinforced retaining wall having distinct or discrete zones incorporating inextensible and extensible reinforcements wherein the transition from inextensible reinforcements in a lower section to extensible reinforcements in an upper section occurs at a predetermined depth below the top of the wall consistent with utilizing the advantageous properties of each material in a synergistic manner, while avoiding the disadvantages inherent in each of these reinforcing systems when utilized independent of the other. The exact depth of the transition is a function of the depth of percolation and the loading that the wall must resist.

It is another object of the present invention to produce a retaining wall having a height of about ten to 20 feet with the wall including layers of extensible reinforcement from the top of the wall of at least about five feet and up to a depth of about 25–90% of the wall height from the top of the wall, the remainder of the wall being reinforced with layers of inextensible reinforcement. For retaining walls having a height of greater than about 20 feet, a portion of the retaining wall from its top to a depth of 50–80% of the wall height with a minimum of about five feet, will include extensible soil reinforcements, the lower remaining portion of the wall including inextensible reinforcements. Once again, the exact depth is based on engineering judgement of the depth of percolation together with the loading that the wall must resist.

It is still yet another object of the present invention to provide a retaining wall having a lower section extending from the base of the wall to a predetermined distance from the top of the wall reinforced with inextensible reinforcement and an upper section reinforced with extensible reinforcement wherein the ratio of the modulus of elasticity of the inextensible reinforcements to the extensible reinforcements, $E_I/E_E$, is between about 10 and about 3000.

These and other objects of the invention, as well as many of the attendant advantages thereof, will become more readily apparent when reference is made to the following description taken in conjunction with the accompanying drawings.

BRIEF DESCRIPTION OF THE DRAWING

The Figure is a schematic sectional view of a retaining wall formed of a plurality of panels or modular wall blocks having a lower region including inextensible reinforcements and an upper region having extensible reinforcements according to the instant inventive concepts.

DETAILED DESCRIPTION OF THE PREFERRED EMBODIMENTS

In describing a preferred embodiment of the invention illustrated in the drawing, specific terminology will be resorted to for the sake of clarity. However, the invention is not intended to be limited to the specific terms so selected, and it is to be understood that each specific term includes all technical equivalents which operate in a similar manner to accomplish a similar purpose.

In the Figure, a retaining wall 10 is made up of a plurality of facing elements in the nature of wall panels or modular wall blocks 12*a–h* which are vertically stacked on top of one another in a known manner. The wall 10 extends from a base or bottom level 14, at the bottom of the lowermost facing element 12*a*, which may be at or below ground level, to the upper surface 16 of uppermost block or panel 12*h*.

Collectively, the panels or block members 12*a–h* form the face of the retaining wall 10. The facing elements 12 each include a front face 20*a–h* and a rear face 22*a–h*. For the instant invention to be of practical relevance, the overall height "a" of the wall is greater than or equal to about ten feet.

Behind the retaining wall 10 is a fill material 24 such as soil or other aggregate. The fill material 24 is reinforced by a plurality of layers of reinforcing material extending from the rear faces 22*a–h* of the block members or panels 12.

According to this invention, in a lower region or zone 26 having a height "b" are a plurality of layers 28*a–e* of inextensible reinforcement extending into the fill material 24 from the rear faces 22*a–22e* of the block members or panels 12*a–e*. The inextensible reinforcements 28*a–e* and their connection to the block members or panels 12*a–e* may be of any form such as those previously described in the aforementioned patents incorporated by reference.

An upper region or zone 30 of the wall 10 has a height "c". In the upper region or zone 30, the block members or panels 12*f–h* include layers 32*f–h* of extensible reinforcement extending from the rear face 22*f–h* of the block members or panels 12*f–h*. The extensible reinforcements 32*f–h* and their connection to the rear faces of the block members or panels may be of any form such as those described in the patents incorporated herein by reference.

The composite reinforced retaining wall of this invention is significantly improved as compared to retaining walls of a comparable height incorporating only extensible reinforcements or a wall incorporating only inextensible reinforcements. Where the retaining wall has a height "a" between about ten and 20 feet, extensible reinforcements are provided in at least the top five feet, comprising between about 25–90% of the total wall height, preferably about 50–90% and in most instances between about 80–90%, identified by the zone "c", inextensible reinforcements being provided in the lower zone "b". Where the height "a" of the wall is greater than about 20 feet, the height "c" of the extensible reinforcements will be provided in the upper zone "c" will be at least about five feet and will preferably comprise about 50–80% of the wall height, the remainder of the wall, the lower zone "b", comprising inextensible reinforcements.

As noted, in each instance, according to this invention, the ratio of the modulus of elasticity ($E_I/E_E$) of the inextensible reinforcements to the extensible reinforcements is between about 10 and is preferably less than or equal to about 3000.

Although the point at which the transition takes place will vary depending on the level of percolation and the loadings that the wall must resist, the general ranges set forth about are applicable to most all designs. The following table illustrates particular transition zones for typical retaining wall constructions:

| Overall Wall Height, Feet | Extensible Reinforcements (Depth From Top of Wall) | Inextensible Reinforcements (Height From Base) |
|---|---|---|
| 10 | 8 | 2 |
| 12 | 10 | 2 |
| 14 | 12 | 2 |
| 16 | 14 | 2 |
| 18 | 16 | 2 |
| 20 | 17 | 3 |
| 25 | 20 | 5 |
| 30 | 20 | 10 |
| 35 | 20 | 15 |
| 40 | 20 | 20 |

By the arrangement of the present invention, an improved retaining wall is formed which maximizes the integrity of the wall in a lower region over an extended period of time by the use of inextensible reinforcements. In an upper region of a wall having a height greater than about 10 feet, extensible reinforcements are used which are resistant to the deleterious effect of corrosive percolate, including rain water and icing salts, for increased performance over time in the composite wall.

Having described the invention, many modifications thereto will become apparent to those skilled in the art to which it pertains without deviation from the spirit of the invention as defined by the scope of the appended claims.

I claim:

1. A retaining wall comprising:

a plurality of wall members stacked in superimposed courses to form a wall having a front face and a rear face, fill material located behind the rear face of the wall and retained by the wall, a plurality of reinforcements extending rearwardly from the rear face of the wall into the fill material, an upper zone of said reinforcements including substantially only extensible reinforcements, and a lower zone of said reinforcements including substantially only inextensible reinforcements.

2. A retaining wall as claimed in claim 1, wherein the fill material is soil.

3. A retaining wall as claimed in claim 1, wherein end portions of each of said plurality of reinforcements are secured to the rear face of said wall.

4. A retaining wall as claimed in claim 1, wherein said wall members are concrete panels.

5. A retaining wall as claimed in claim 1, wherein said wall members are modular wall blocks.

6. A retaining wall as claimed in claim 5, wherein said modular wall blocks are made of concrete.

7. A retaining wall as claimed in claim 1, wherein said extensible reinforcements have a modulus of elasticity, $E_E$, of between about $10\times10^3$ and $10\times10^5$ PSI.

8. A retaining wall as claimed in claim 1, wherein said inextensible reinforcements have a modulus of elasticity, $E_I$, of between about $10\times10^6$ and $30\times10^6$ PSI.

9. A retaining wall as claimed in claim 1, wherein the ratio, $E_I/E_E$, of the modulus of elasticity between the inextensible reinforcements and the extensible reinforcements is at least about 10.

10. A retaining wall as claimed in claim 9, wherein the ratio, $E_I/E_E$, of the modulus of elasticity between the inextensible reinforcements and the extensible reinforcements is equal to or less than about 3000.

11. A retaining wall as claimed in claim 1, wherein said inextensible reinforcements are made of metal.

12. A retaining wall as claimed in claim 11, wherein said inextensible reinforcements comprise metal strips.

13. A retaining wall as claimed in claim 11, wherein said inextensible reinforcements comprise sheets of welded wire mesh.

14. A retaining wall as claimed in claim 1, wherein said extensible reinforcements are made of plastic.

15. A retaining wall as claimed in claim 14, wherein said extensible reinforcements comprise sheets of a grid-like material.

16. A retaining wall as claimed in claim 15, wherein said sheets of grid-like material comprise integral geogrids.

17. A retaining wall as claimed in claim 14, wherein said extensible reinforcements comprise sheets of geotextile.

18. A retaining wall as claimed in claim 1, wherein said retaining wall is between about ten and 20 feet in total height and said upper zone is at least five feet and extends to a depth of about 25–90% of the wall height from the top of said wall.

19. A retaining wall as claimed in claim 18, wherein said upper zone comprises between about 50–90% of the wall height.

20. A retaining wall as claimed in claim 1, wherein said retaining wall is in excess of about 20 feet in height and said upper zone extends to a depth of about 50–80% of the wall height from the top of said wall.

21. A retaining wall comprising:

a plurality of wall members stacked in superimposed courses to form a wall having a front face and a rear face and a total height at least about ten feet, fill material located behind the rear face of the wall and retained by the wall, a plurality of reinforcements extending rearwardly from the rear face of the wall and into the fill material, an upper zone of said reinforcements including substantially only extensible reinforcements having a modulus of elasticity, $E_E$, of between about $10\times10^3$ and $10\times10^5$ psi, said upper zone being at least five feet from the top of said wall and extending to a depth of between about 25 and 90% of the wall height from the top of the wall, a lower zone of said reinforcements comprising the remainder of the height of said wall height including substantially only inextensible reinforcements having a modulus of elasticity, $E_I$, of between about $10\times10^8$ and $30\times10^6$ psi, and the ratio $E_I/E_E$ of modulus of elasticity of said inextensible reinforcements to said extensible reinforcements being at least about 10.

22. A retaining wall as claimed in claim 21, wherein said ratio is no greater than about 3000.

23. A retaining wall as claimed in claim 21, wherein said fill material is soil.

24. A retaining wall as claimed in claim 21, wherein end portions of each of said plurality of reinforcements are secured to the rear face of said wall.

25. A retaining wall as claimed in claim 21, wherein said wall members are selected from the group consisting of concrete wall panels and concrete modular wall blocks.

26. A retaining wall as claimed in claim 21, wherein said inextensible reinforcements are selected from the group consisting of metal strips and welded wire mesh.

27. A retaining wall as claimed in claim 21, wherein said extensible reinforcements are selected from the group consisting of plastic geogrids and plastic geotextiles.

28. A retaining wall as claimed in claim 21, wherein the height of said wall is between about ten and 20 feet and said upper zone comprises about 50–90% of the wall height.

29. A retaining wall as claimed in claim 21, wherein the height of said wall is at least about 20 feet and said upper zone comprises about 50–80% of the wall height.

* * * * *